US005947039A

United States Patent [19]

Lundgren et al.

[11] Patent Number: 5,947,039

[45] Date of Patent: Sep. 7, 1999

[54] MIXING TOOL WITH FLUID INJECTION

[75] Inventors: Michael A. Lundgren; Bob A. Lundgren, both of Sonora, Calif.

[73] Assignee: Lundgren Systems, Sonora, Calif.

[21] Appl. No.: 08/829,831

[22] Filed: Mar. 25, 1997

[51] Int. Cl.[6] ..... B67D 3/00

[52] U.S. Cl. ..... 111/7.1; 239/289; 239/532

[58] Field of Search ..... 111/7.1; 366/1, 366/130; 294/49, 51, 57; 239/289, 532, 566

[56] References Cited

U.S. PATENT DOCUMENTS

| | | | |
|---|---|---|---|
| 1,103,484 | 7/1914 | Clarke . | |
| 1,408,584 | 3/1922 | Glasgow . | |
| 1,598,811 | 9/1926 | Ferrin | 111/7.1 X |
| 1,764,699 | 6/1930 | Simola . | |
| 2,181,189 | 11/1939 | Lathan | 47/49 |
| 2,804,767 | 9/1957 | Schoen | 111/7.1 X |
| 3,143,984 | 8/1964 | Morasch | 111/7.1 |
| 3,326,306 | 6/1967 | Weir | 175/207 |
| 4,704,758 | 11/1987 | Hoffman | 294/57 X |
| 5,287,994 | 2/1994 | Dempsey | 111/7.1 X |

*Primary Examiner*—Christopher J. Novosad
*Attorney, Agent, or Firm*—Mark E. Baze; Larry B. Guernsey; Michael J. Hughes

[57] ABSTRACT

A hand-held water injecting tool (10) provides for the admixture of water to cementitious materials. The tool (10) is generally comprised of a water-conveying tubular body (12), and a blade assembly (16) having a tip (17). The tubular body (12) has a circuitous configuration to afford both a built-in, ergonomic handle portion (35) and a capacity to perform mixing operations within relatively high-walled containers. At a water-emitting end (20) are present a pair of nozzles (52) which are integrally fashioned from the tubular body (12) to impart jet action to the emitted water. The blade assembly (16) includes a generally triangularly shaped blade (62) attached to the second end (20) such that the water is emitted from the nozzles (52) at a location proximate and external to the blade tip (17) so that the force of the fluid is used in close conjunction with mechanical action of the blade. An alternative embodiment (710) provides a second end (720) adapted to receive a tang (82) of a blade (762) having an arrow-like or "winged" appearance. Channels (86) upon either side of the tang (82) function as nozzles (752) which are shielded from an influx of solid particles by the thickness of the blade (762) to afford an anti-clogging capability. A second alternative embodiment (810) provides a check valve system constituted by a blade (862) having a depressed portion (88) within which the second end (820) lies and a flap (90) which covers the second end (820) and depressed portion (88).

20 Claims, 9 Drawing Sheets

MIXING TOOL WITH FLUID INJECTION

TECHNICAL FIELD

The present invention relates generally to mixing tools having integral water-delivery systems and further to hand tools such as hoes and the like, and more particularly, to such tools as are used for preparing slurries from dry cementitious materials.

BACKGROUND ART

A large number of hand tools such as hoes, spades, and axes exist which are adapted to have a built-in water-conveying ability in addition to their more commonly associated mechanical function. In the areas of gardening, mixing of cement and mortar, and firefighting, in particular, such "water tools" have been found to be especially useful. They provide that the worker need not have to bother with a separate water source—a garden hose or bucket, for example-in order to supply the water that is needed at a work site when cultivating, mixing, or extinguishing, etc. In the case of the mixing or slurrying of cementitious "dry mix" products especially, they further provide that a correct water:mix ratio is more easily obtained since the water may be introduced in multiple small portions as the mixture is alternately stirred and agitated with the mechanical aspect of the tool (i.e., a hoe blade).

Most of the prior art tools which are adapted to convey water include a blade of some form—a hoe, spade or axe blade, etc. A common theme among these inventions is the incorporation of a design wherein the water that is conveyed by the tool (generally via a tubular handle body) is emitted in such a manner that it is caused to impinge or otherwise be broadly dispersed upon the blade surface. This is done so that the blade may be simultaneously cleaned in the process of delivering the water and/or so that the force of the water is dissipated to avoid undue disruption of the solid media (e.g., soil or dry mix) that is being worked.

Shown in U.S. Pat. No. 3,143,984, issued to Morasch in 1964, is a garden hoe comprised of a tubular water-conveying handle body in communication with a transversely mounted tubular hoe head. The hoe head incorporates a plurality of water-emitting apertures located at the uppermost part of a depending hoe blade. The apertures are purposefully oriented to direct the emitted water in a broad cleaning fashion along both of the inner and outer blade surfaces so that clinging soil may be washed away and so that spot watering of plants may be achieved without disruption of the garden soil. The invention of Morasch might obviously be used for the mixing of cementitious dry mix as well.

Similar to Morasch is U.S. Pat. No. 1,408,584, issued to Glasgow in 1922. Again a hoe is provided, this time for mixing cement. A tubular handle for conveying water is also provided, but rather than provide an associated tubular hoe head, a distinct "sprinkler" element is connected atop the tubular handle which directs streams of water against the inner face of a conventional hoe blade. The sprinkler orifices are again located at the uppermost part of the hoe blade (actually slightly thereabove) and are specifically oriented to distribute the emitted water as a film along the blade and thus broadly over the dry mix.

Another mortar mixing tool is shown in U.S. Pat. No. 1,764,699 issued to Simola et al. in 1930. In this case, a secondary tubular structure for conveying water is attached in parallel fashion to a completely conventional (i.e., solid wood) hoe handle. The water is emitted from an outlet orthogonally directed against the inner hoe blade face so that the water is again caused to be broadly dispersed.

With respect to the mixing of cement and mortar, each of the foregoing inventions are identically deficient. For while they are useful in that they eliminate the need for the worker to have to exchange back and forth between a hoe and a separate water supply in the course of gradually combining water with the dry mix to obtain a desired consistency, and while they also assist in making less difficult the attainment of a proper water to dry mix ratio, they fail to realize that the emitted water itself may be used to aid in the mixing and slurrying process (as will later be detailed) and not just be conveyed to the site of use in some convenient, integral fashion.

Due to the high density and natural compaction of cementitious dry mixes, it is very difficult to penetrate and stir such materials with a conventional mixing tool (i.e., a hoe or hoe-like tool) prior to the in-mixing of water. In the case of each of the foregoing inventions, the water is (or would be) merely deposited on top of the layer of dry mix or, at best, into a depression created by the hoe blade just prior to release of water. As such mixes do not readily absorb water, the water remains separate until it is aggressively stirred into the dry material. Thus, inventions such as the foregoing, in terms of effecting the rate of dissolution and slurrification of dry mix, are little better than methods in which water is added portionwise from a bucket into a wheel barrow or other container of the mix with alternate stirring with a conventional mixing tool.

Additional prior art of interest is shown in U.S. Pat. Nos. 3,326,306 and 2,181,189. The '306 patent, issued to Weir in 1967, provides a "water spade" having a tubular water-conveying body with a slotted end within which a triangular blade (or blades) is fixed. Water is caused to flow in parallel relation from the top and to each side of the blade. In the process, the blade is cleaned and the force of the flow of water also assists in the "drilling" of holes by dislodging and softening compacted earth.

In the '189 patent, issued to Lathan in 1939, is shown what may be deemed a "water fork." Again a tubular water-conveying body is provided. At one end, the tubular body is bent to form an integral, angled handle portion, at the other, the body is partially flattened to provide for a wider flow of water upon the tines of a fork portion. The fork portion is attached to the tubular body by slotting the flattened body portion, inserting the fork portion into the slot, and then welding it in place. The water flows from very near the top of the fork (blade) portion, as it does in the case of every other such similar tool having an associated blade as has been known heretofore.

The methodologies of Weir and Lathan, even were they adapted to hoe structures suitable for mixing cementitious materials, still would not utilize the emitted water in ways that most advantageously increase the rate of mixing of the cementitious materials.

Because of the limitations associated with presently available tools, a great need still exists for a tool that is capable of conveniently conveying water in a built-in or integral fashion while also utilizing the emitted water in a manner that increases the rate of dissolution and suspension of dry cementitious materials into the water and which further reduces the effort needed to stir or otherwise agitate such a mixture in the process of obtaining a slurry.

DISCLOSURE OF THE INVENTION

Accordingly, it is an object of the present invention to provide a water-conveying hand tool for the rapid and efficient preparation of aqueous slurries of dry cementitious materials with less effort than previously possible.

It is another object of the invention to provide such a hand tool in which the water emitted affords a supplemental or synergistic mixing capability with the mechanical action of an associated blade element.

It is a further object to provide such a hand tool in which the water emitted is injected into and beneath the dry mix.

It is yet another object to provide such a hand tool in which the water is emitted at a location relatively proximate a lower blade point or edge of an associated blade element.

It is yet a further object to provide such a hand tool in which the water is emitted in a jet action fashion substantially parallel to an associated blade element.

It is still another object to provide such a hand tool having jet action nozzles integrally fashioned from a tubular water-conveying body.

It is a still further object to provide such a hand tool having an ergonomic handle portion integrally fashioned from a tubular water-conveying body.

It is yet another object to provide such a hand tool having an ability to prepare such slurries within relatively high-walled containers.

It is yet a further object to provide such a hand tool with a built-in resistance to clogging from particulate cementitious material.

It is still another object of the present invention to provide such a hand tool that is minimally complex in construction and inexpensive to manufacture and sell.

Briefly, the preferred embodiment of the present invention is a hand-held water injecting tool, related generally in form to hoes and hoe-like apparatus, for the admixture of water to dry cementitious materials to rapidly and efficiently prepare properly constituted slurries thereof.

The water injecting tool is generally comprised of a water-conveying tubular body, a valve assembly, and a blade assembly. The tubular body has a seemingly circuitous configuration that includes a number of integrally contiguous linear and arcuate sections to afford both a built-in, ergonomic handle portion and a capacity to perform mixing operations within relatively high-walled containers.

The valve assembly attaches to a first end of the tubular body and permits connection of a pressurized water supply via a hose. The valve assembly includes a conventional spray gun which, in addition to permitting regulation of the water supply, provides a second hand-hold for operation of the tool.

At a water-emitting second end of the tubular body are present a pair of parallely oriented nozzles which are integrally fashioned from the tubular body and which present orifices of sufficiently small size to impart a jet action to the water that is emitted.

The blade assembly includes a generally triangularly shaped blade that is attached to the second end of the tubular body such that the water is emitted from the nozzles at a location relatively proximate the blade point in order to permit injection of the water into and beneath the layer of mix.

There is also provided an alternative embodiment which again has a circuitous tubular body similar to the above but which has a water-emitting second end that is partially flattened to give a reception portion of a uniform semi-rectangular, semi-elliptical shape. An alternative blade assembly includes a blade with an arrow-like or "winged" appearance. The alternative blade includes opposed left and right wing portions bisected by an integrally fashioned tang. The tang is inserted within the reception portion to form channels upon either side of the tang which again function as nozzles to impart a jet action to the emitted water.

The arrow-like blade, in addition to reducing resistance to movement through the mixture, provides that the nozzles are shielded from an influx of solid particles by the blade thickness present near the junctures of the wing portions and tang and thus affords an anti-clogging capability. Further, this blade design additionally splits the water emitted by each nozzle or channel into two streams which flow down both the back and the front of the blade.

There is further provided a second alternative embodiment which again has a circuitous tubular body and, like the original embodiment, has a water-emitting second end that includes integrally fashioned nozzles. A second alternative blade has a triangular shape similar to the original blade but is further provided with a depressed portion having a shape within which an extent of the second end may lie.

A flap lies upon the rear face of the blade and is of a size and shape to cover the second end (and the recessed portion) in a check valve fashion. The flap is "spring loaded," such that when water is ejected from the nozzles, the flap is caused to lift from the blade point to permit emission of the water from out of the recessed portion. When the water flow is made to stop, the periphery of the flap again flushly presses upon the blade surface effectively creating a seal that surrounds the second end and prevents an influx of particulate matter from clogging the tool as a pressure drop occurs therein.

An advantage of the present invention is that it not only conveniently conveys water to the work area, but also uses the flow of the emitted water to assist in the mixing process, thereby reducing the preparation time and effort required.

Another advantage of the invention is that it provides that self-dissolution and self-slurrification of the dry mix is encouraged because the mix is required to gravitate into water that has been injected into or beneath the layer of mix.

A further advantage is that the locus of the water emission provides for a liquefacient effect of the cementitious material that comes in contact with the blade point, thereby greatly reducing the effort needed to penetrate and move the blade through the mix.

Yet another advantage is that the forcible jet action afforded by the nozzles assists in making penetration of the blade into the mix much more easy, while also affording a supplemental or synergistic agitating action to that provided by the mechanical aspect of the blade.

Yet a further advantage is that accurate water:mix ratios are easily obtained since the water is mixed into the dry material almost immediately upon injection and feedback to the worker as to proper consistency is therefore rapid.

Still another advantage is that troublesome compacted lower layers and comer areas of dry mix within containers are easily reached and hydrated to prevent caking.

Still a further advantage is that mixing occurs largely under the material, thereby reducing splash.

Yet another advantage is that the ergonomic shape facilitates effective force transfer to the blade and ease of comfort in using the tool.

Yet a further advantage is that the triangle blade shape assists in penetration through the material being worked and also permits facile scraping and mixing of material along the angled sides and comers of containers such as wheelbarrows.

These and other objects and advantages of the present invention will become clear to those skilled in the art in view of the description of the best presently known mode of carrying out the invention as described herein and as illustrated in the several figures of the drawings.

DESCRIPTION AND BEST MODE OF THE INVENTION

Figure 1:
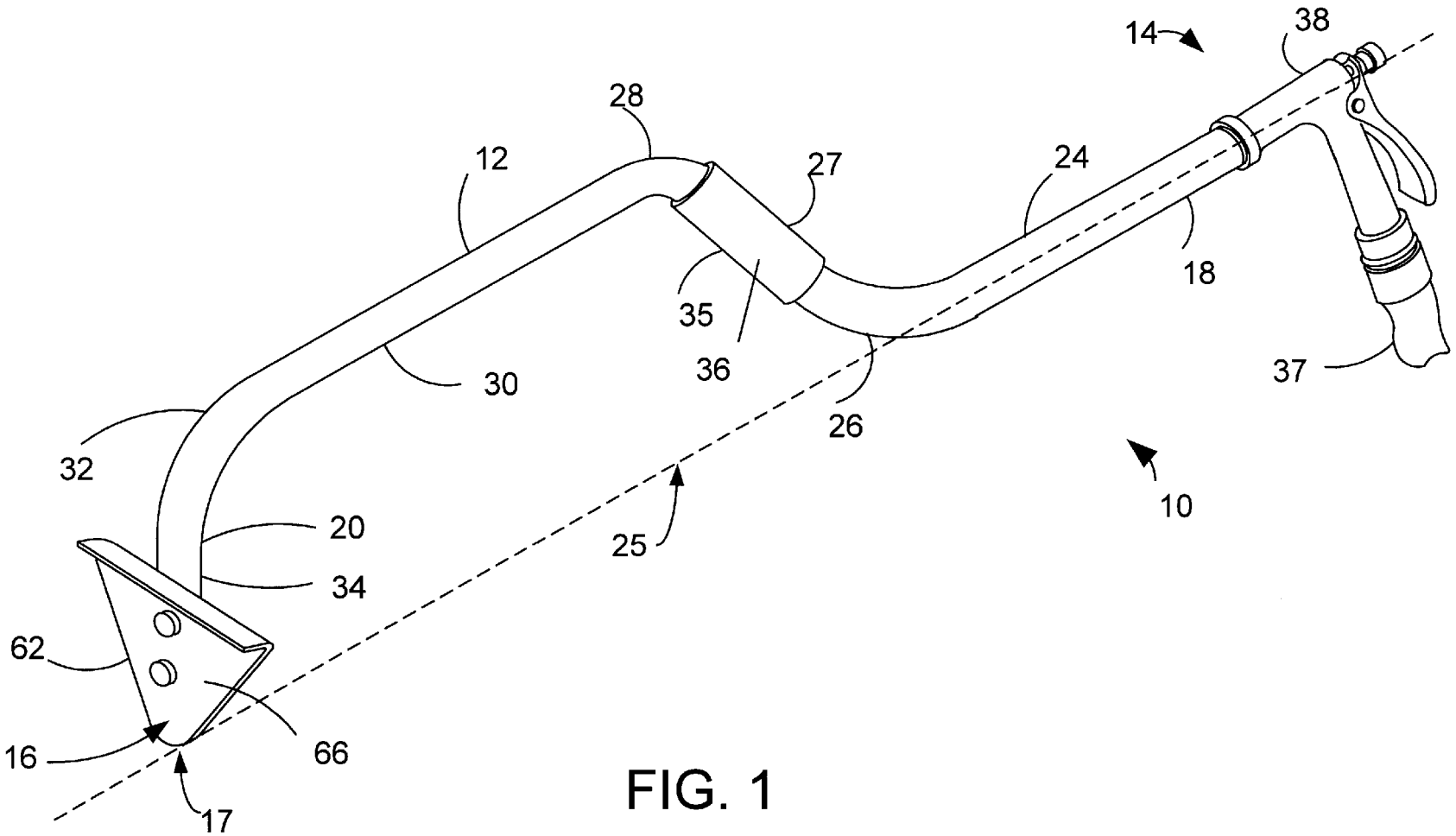
FIG. 1 is a perspective view of a water injecting tool of the preferred embodiment of the present invention.

The preferred embodiment of the present invention is a hand-held water injecting tool for the admixture of water to dry cementitious materials to form properly constituted slurries thereof. The water injecting tool of the preferredembodiment is set forth in FIGS. 1 and 2, where it is designated therein by the general reference character 10.

Figure 2:
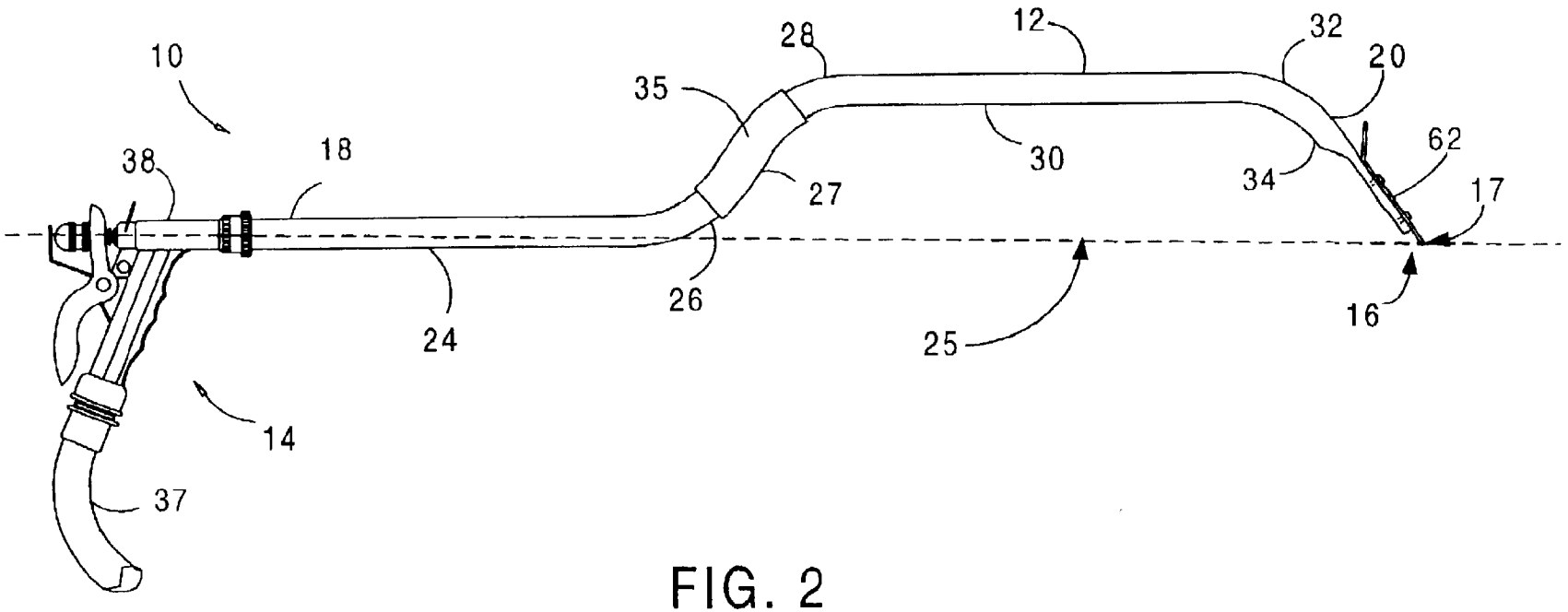
FIG. 2 is a side elevational view of the tool of FIG. 1.

Referring initially to the perspective and side views in FIGS. 1 and 2 of the drawings, respectively, the water injecting tool 10 is shown to be comprised of elements of three major types. Thus, present are a seemingly circuitous tubular body 12, a valve assembly 14, and having a tip 17, of which only the valve assembly 14 is conventional in nature. By a mostly concerted action, and largely due to the unique manner and location at which water is dispensed from the tubular body 12 in the blade assembly 16 region, these primary elements together provide a highly efficient water-dispensing implement for the expedient small scale mixing of concrete and mortar and the like, as will now be explained in detail.

Figure 3:
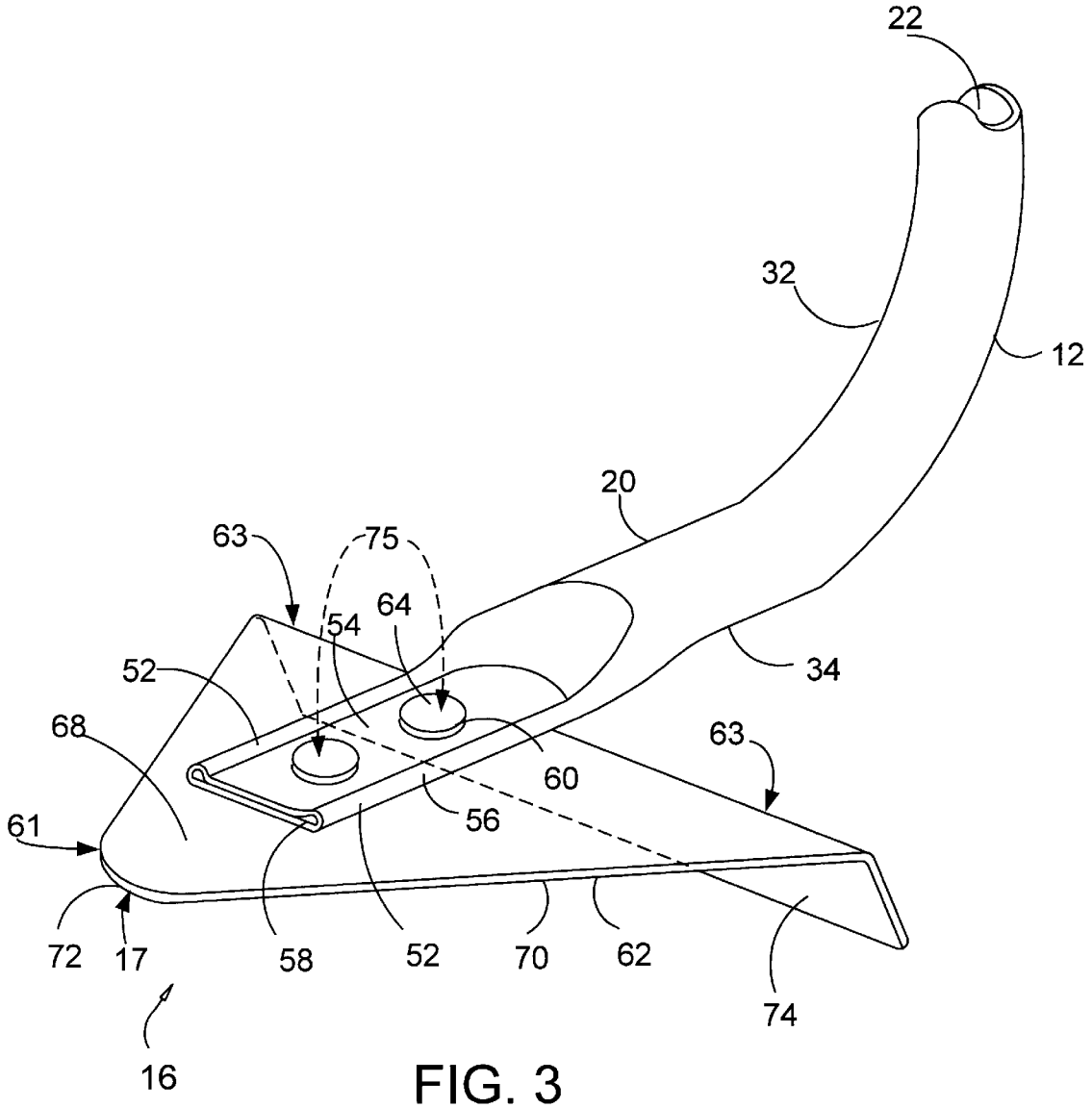
FIG. 3 is a perspective view of the water-emitting second end and associated blade assembly of the tool of FIG. 1, showing the rear side of the blade.

Continuing to refer to FIGS. 1 and 2, with reference now also to the view of FIG. 3 of the drawings, the tubular body 12 is shown to include what are denoted herein as an inlet or first end 18 and an outlet or second end 20. The first and second ends (18 and 20) are adapted to receive the valve assembly 14 and the blade assembly 16, respectively, the second end 20 being further modified for water emission and injection purposes that are peculiar to the present invention, as will be detailed later. A cylindrical inner bore 22 (FIG. 3) is in open communication with the first and second ends (18 and 20) and extends continuously therebetween to form a pipe passage capable of conveying a fluid between those two ends (18 and 20).

In the preferred embodiment, the tubular body 12 is comprised, in Contiguous integral fashion, of a first linear section 24, having a longitudinal axis 25 an upturned first arcuate section 26, a short, transitional second linear section 27, a sideturned second arcuate section 28, a third linear section 30 which has a length substantially similar to that of the first linear section 24, a downturned third arcuate section 32, and a short fourth linear section 34. The first and fourth linear sections (24 and 34) are shown to incorporate the first and second ends (18 and 20) of the tubular body 12, respectively.

Each of the first, second and third arcuate sections (26, 28 and 32) are substantially identical and have a bending radius of approximately 70 degrees, although it would be apparent that other radii or bending formations (including sharp angular and irregular formations) could achieve substantially the preferred shape. The preferred tubular body 12 has an overall length, as measured in direct fashion from the first end 18 to the second end 20, of approximately 80 cm (31.5 in.), and is fashioned from 1.9 cm (0.75 in.) diameter steel tubing.

The seemingly circuitous configuration of linear and arcuate sections (24, 27, 30 and 34, and 26, 28 and 32) described and shown actually provides a number of important functions as follows: The arrangement, which results in the two long linear sections (24 and 30) being presented in an offset but parallel planar relation, provides a tool 10 having an extended working length while simultaneously affording a built-in handle portion 35. The handle portion 35 is generally located in the region of the first and second arcuate sections (26 and 28) and the transitional linear section 27. Thus, a handle means is integrally fashioned from the water-conveying means and no supplemental handle component need be separately fabricated and attached, thereby facilitating the manufacture and overall simplicity of the tool 10. In the preferred embodiment, the tip 17 of the blade assembly 16 lies near a projection of the longitudinal axis 25 of the first linear section 24. This proximity allows an efficient transfer of force along the length of the tool 10, as well as providing a sense of position of the blade 16 when it may be out of sight, as when submerged in slurry.

The handle portion 35 as provided has no left or right orientation and is therefore equally suited to a worker who is either left- or right-handed. In addition, and moreover, the orientation and situs of the handle portion 35 is ergonomically advantageous. That is, during mixing, in which either the left or right hand is used to grasp the handle portion 35 (the other hand holding the valve assembly 14, as will be explained below), the wrist is caused to be in a comfortable, slightly supinated orientation by virtue of the angled disposition of the relevant portion of the tubular body 12. The orientation of the handle portion 35 also makes force transfer much more effective when making back and forth mixing motions as compared to traditional, linear-type hoe handles. The hand is able to push and pull against a member oriented transversely to the necessary line of force, rather than having to rely on strength of grip in grasping a traditional handle that is simply disposed parallel to the line of force along its entire length. In the preferred embodiment, the handle portion 35 is angled at approximately 30 degrees from vertical in the direction of the second end 20.

The configuration, with its removed, depending fourth linear section 34, also provides a clearance beyond that offered by conventional hoes to provide a tool 10 which is especially well adapted to mixing within walled containers such as wheel barrows and buckets. Clearance could be increased, of course, were that necessary, by lengthening the fourth linear section 34 (and the transitional second linear section 27, if desired).

About the handle portion 35 there is provided a soft, resilient grip member 36. The grip member 36 preferably consists of an elongated tube of foam rubber or the like within which the tubular body 12 is inserted during the assembly process. The grip member is secured to the handle portion 35 by glue or a similar method and provides a soft cushioning for the hand during mixing.

It would be apparent that other bending configurations of the tubular body 12 might be employed to obtain a built-in handle portion such as 35. For example, the described first arcuate section 26 might be downturned rather than upturned. This would result in the blade assembly 16 being positioned somewhat lower relative to the hands and might be more comfortable for taller workers. Of course, such a convenient, ergonomic built-in hand portion might even be eliminated were it desired that the tubular body 12 simply be straight along its entire length, i.e., as with a common garden hoe (except perhaps for the presence of a depending section such as the fourth linear section 34 of the shown embodiment, which permits mixing within walled containers, as mentioned). The circuitous design of the tubular body 12, with its attendant advantages over conventional straighthandled hoes, is but one unique aspect of the present invention and is entirely separable from further aspects as will be described. Thus, the circuitous design might, for example, be incorporated into a hoe for gardening—without or without an integral water-conveying capability.

Figure 4:
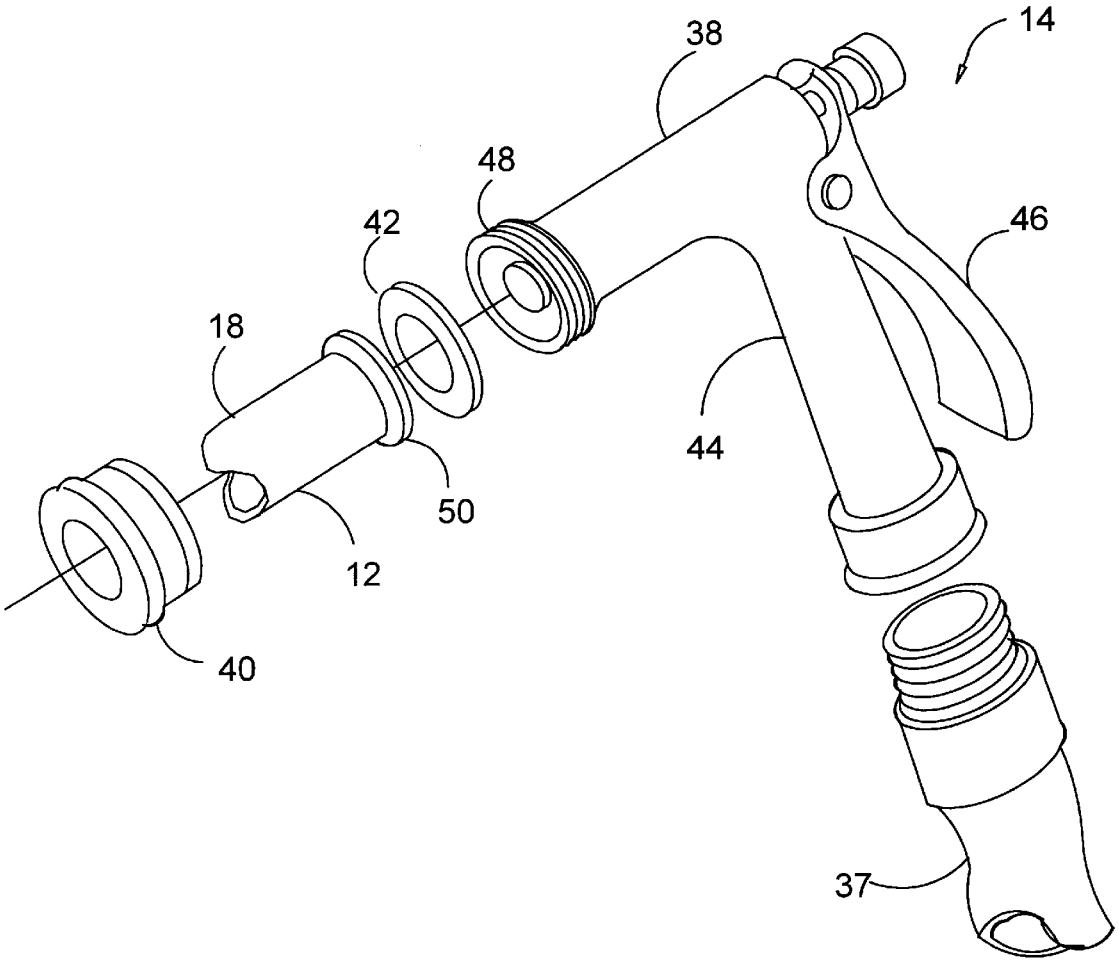
FIG. 4 is a perspective view of the inlet first end and associated valve assembly of the tool of FIG. 1.

With reference now to the view of FIG. 4, the valve assembly 14 attaches to the first end 18 of the tubular body 12 and permits connection and regulation of a pressurized water supply (preferably supplying at least 35 psi of working pressure) via a hose 37. Thus, the user of the water injecting tool 10 can cause water to flow through the inner bore 22, from the first end 18 and out the second end 20, as desired. The valve assembly 14 includes an off-the-shelf spray gun 38, a coupling member 40, and a washer style compression gasket 42. The spray gun 38 may be of the type available from any number of commercial sources and is specifically designed for attachment to standard water supply hoses such as plastic or rubber garden hoses (i.e., hose 37) and the like. As is common, the spray gun 38 includes a pistol grip style handle 44 and an actuating trigger lever 46. As is also common, a spraying end 48 is externally threaded for reception within an internally threaded mating element which, in this case, corresponds to the coupling member 40. The coupling member 40 has the form of the ubiquitous threaded cup-type nut commonly employed with virtually all manner of garden hoses in order to permit their connection to common household water spigots. As alluded to above, the handle 44 of spray gun 38 provides a second hand-hold for operation of the tool 10.

The coupling member 40 is captured upon the first end 18 of the tubular body 12 by a circumferential flange 50 that is integral with the tubular body 12. The flange 50 is formed by flaring the first end 18 in a mechanical pressing operation after the coupling member 40 has been passed over an as-of-yet unflared first end 18. The compression gasket 42 is disposed between the flange 50 and the spraying end 48 and provides a seal between the tubular body 12 and the spray gun 38 when the spraying end 48 and the coupling member 40 are threaded together.

Referring again to FIG. 3, at the water-emitting second end 20 of the tubular body 12, and comprising much of the length of the fourth linear section 34, are present a pair of parallely oriented nozzles 52 and a cross-web 54 which extends transversely therebetween. Each nozzle 52 is a substantially tubular structure and includes a duct 56 and an orifice 58. Located within the cross-web 54 and extending therethrough are a pair of apertures 60 to permit attachment of the blade assembly 16, which is described below.

The nozzles 52 and cross-web 54 are integrally fashioned from the tubular body 12 by symmetrically crimping or flattening a center area of the fourth linear section 34 to such a degree that opposing surfaces of the inner bore 22 are brought into contact. (A dual-pronged mandrel is placed within the second end 20 of the tubular body 12 in a mechanical pressing operation to assist in the shaping of the ducts 56.) Thus, water traveling through the inner bore 22 is restricted from flowing out the region of the second end 20 that is sealed by the cross-web 54 and is instead diverted through the ducts 56 and out the orifices 58.

It will be immediately evident that the ducts 56 have a cross-sectional area very much reduced in size relative to the inner bore 22 from which the ducts 56 are derived. The constriction presented by the cross-web 54 and narrow ducts 56 provides that the velocity of the water which exists from the orifices 58 is greatly increased over the water that has previously traveled within the inner bore 22. The resulting "jet action" is of considerable importance to the efficient operation of the water injecting tool 10, as will be described below.

It would be apparent that more (or less) than two nozzles such as 52 could be provided and that such nozzles 52 need not be structures integrally fashioned from the tubular body 12. For example, a separate fixture comprised of a group of multiple nozzles might be fashioned in a casting or extrusion process in which the fixture is provided with an interface such that it might be welded, screwed, or otherwise attached onto an appropriately modified second end 20.

In the preferred embodiment, and continuing to refer to FIG. 3, the blade assembly 16 includes a generally triangularly shaped blade 62 having an upper blade edge 63 and a lower blade edge 61, which in a triangular blade terminates in a tip 17, and a pair of rivets 64. The blade 62 is relatively thin and is flat, similar to most hoe blades, and is seen to have a front or first side 66 (FIG. 1), a rear or second side 68 (FIG. 3), and a pair of opposing side edges 70. In the preferred embodiment, the opposing side edges 70 constitute an included angle of approximately 90 degrees. It will be apparent that a relatively substantial deviation could be made from this called out angle while still retaining most of the benefits (to be described below) of a triangular blade design.

The substantially triangular shape of the blade 62 is modified by having radius comers, the lower of which comers is designated as a blade point 72. The blade 62 is further modified by a horizontally oriented blade flange 74 which extends outward from the plane of the blade 62. The flange 74 imparts additional strength and stiffness to the blade 62 to prevent bending in the event the water injecting tool 10 is dropped or otherwise mishandled and further assists to some degree in mixing, as is described immediately following.

The "pointed" triangular shape of the blade 62 assists in the slurrifying of cementitious dry-mix materials by making penetration and movement through these relatively dense materials less difficult. The triangular shape also means that when mixing is performed in a wheelbarrow, as is commonly done, only a minor rotation of the tool 10 is needed to quickly bring a blade side edge 70 parallel to the left or right side portions, or bottom, of the wheelbarrow. Thus, the angled side edges 70 provide that adhering material is easily scraped and mixed from the sides or bottom of such containers.

The fact that the blade point 72 is arcuately rounded permits effective mixing and movement of material within and along the comers of most common mixing containers (such as wheelbarrows) since, while a more pointed blade might be better for penetration purposes, movement of material within such comers (and along the bottom of the container) would be problematic with a sharper point.

Some assistance in mixing is also provided by the flange 74, which tends to drive the blade 62 downwards as the tool 10 and blade 62 are pulled toward the worker in a back and forth mixing motion. The flange 74 also imparts a partial cup-like shape to the blade 62 which assists in moving material as the tool 10 is pushed away from the worker for "stockpiling" purposes so that the consistency of the mixture can be more carefully adjusted.

The blade 62 also includes a pair of apertures 75 (not visible) which are capable of being aligned with the apertures 60 present within the cross-web 54 of the tubular body 12. During assembly, the second side 68 of the blade 62 is affixed upon the cross-web 54 using the rivets 64. Thus, in addition to providing water flow restriction, the cross-web 54 presents a flat surface so that the attachment of the blade 62 to the second end 20 of the tubular body 12 is a secure and stable one. It will be noted that the attachment of the blade assembly 16 in the preferred embodiment provides that the pair of nozzles 52 are aligned parallel to the plane of the blade 62 and thus the strength of the jet action of the two streams of water produced is not significantly reduced by any interaction with the blade 62.

Critical to the effectiveness of the present invention, and unlike all prior art known heretofore, is the fact that the blade 62 attachment design provides that the water which is emitted by the tool 10 is emitted from the lower part of the blade 62 at a location relatively close to the blade point 72. The water is therefore able to be injected into and under the cementitious mix such that the mix essentially falls back into the water and is at least partially "self-slurried" in the process, rather than the water being dispensed on top of the mix where it is prone to lie due to the anhydrous and compacted nature of the mix. Thus, the phenomenon of "pancaking" is avoided, in which in the case of known mixing tools, the worker is required to repeatedly penetrate into layers of dry mix which has not combined with water in order in order to slurry all of the mix. The water injection capability afforded by the present invention greatly reduces the amount of time expended and effort exerted in preparing a cementitious slurry.

Equally important, and perhaps even more critical, is that by virtue of the water being emitted near the blade point 72, a liquefaction of cementitious material occurs close to the point where the blade 62 first makes contact with any dry material. This liquefaction also reduces the effort needed to penetrate and move the blade 62 through the mix in the course of preparing the slurry.

Further, as noted above, the water is emitted in jet-action fashion. This jet action also assists in making penetration and movement of the blade 62 through the mix more easy (in conjunction with the triangular shape of the blade 62) while, in addition, affording a supplemental agitating action to that provided by simple mechanical movement of the blade 62.

Thus, for the first time, there is a provided by the present invention a water-conveying mixing tool in which the emitted water actually aids in the mixing process and is not just simply conveyed to the site of use in a convenient integral fashion.

It would be apparent that the blade assembly 16 (and second end 20) might take a shape and form other than that which has just been described. For example, a traditional, rectangularly shaped garden-type hoe blade might be employed, where again the water is emitted in jet action fashion at a location near the lower edge of such a blade (some loss in efficiency would be expected, though, especially with regard to accessing for slurrying incompletely hydrated material present within the comers of a container).

Figure 5:
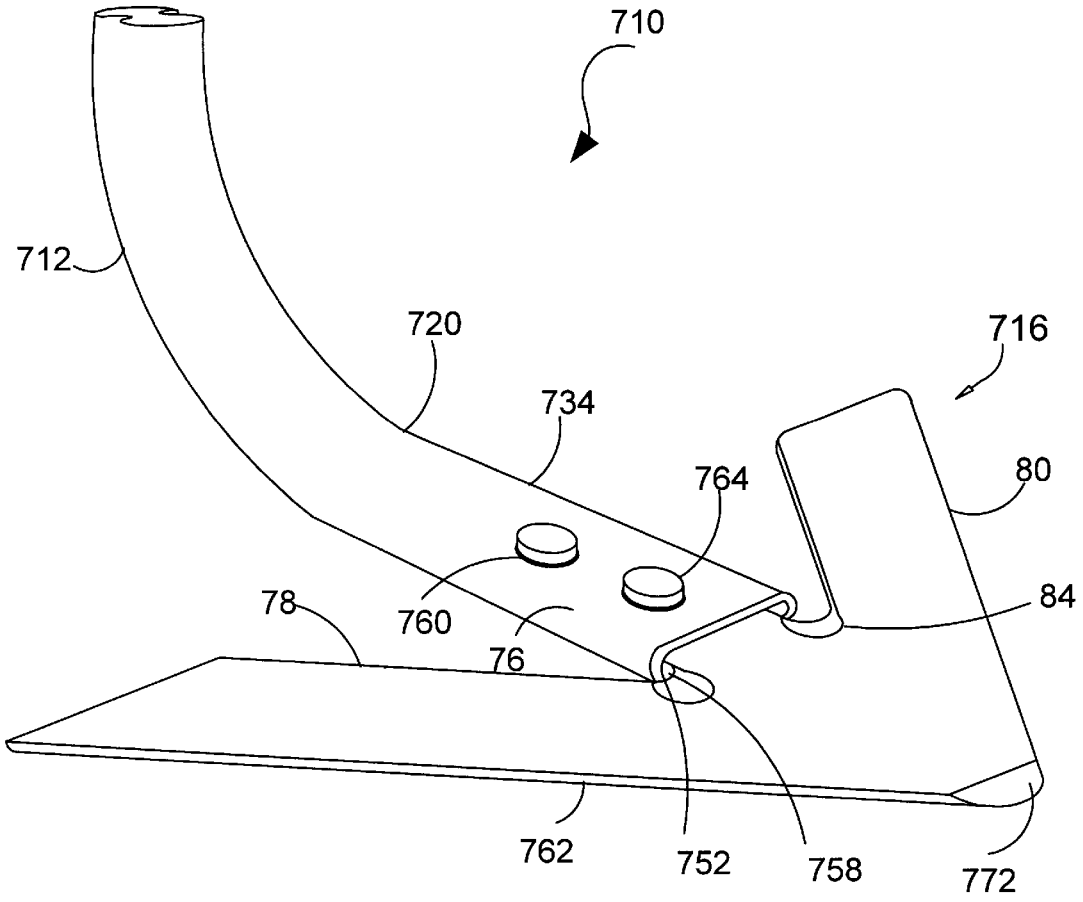
FIG. 5 is a perspective view of an alternative water-emitting second end and alternative associated blade.
Figure 6:
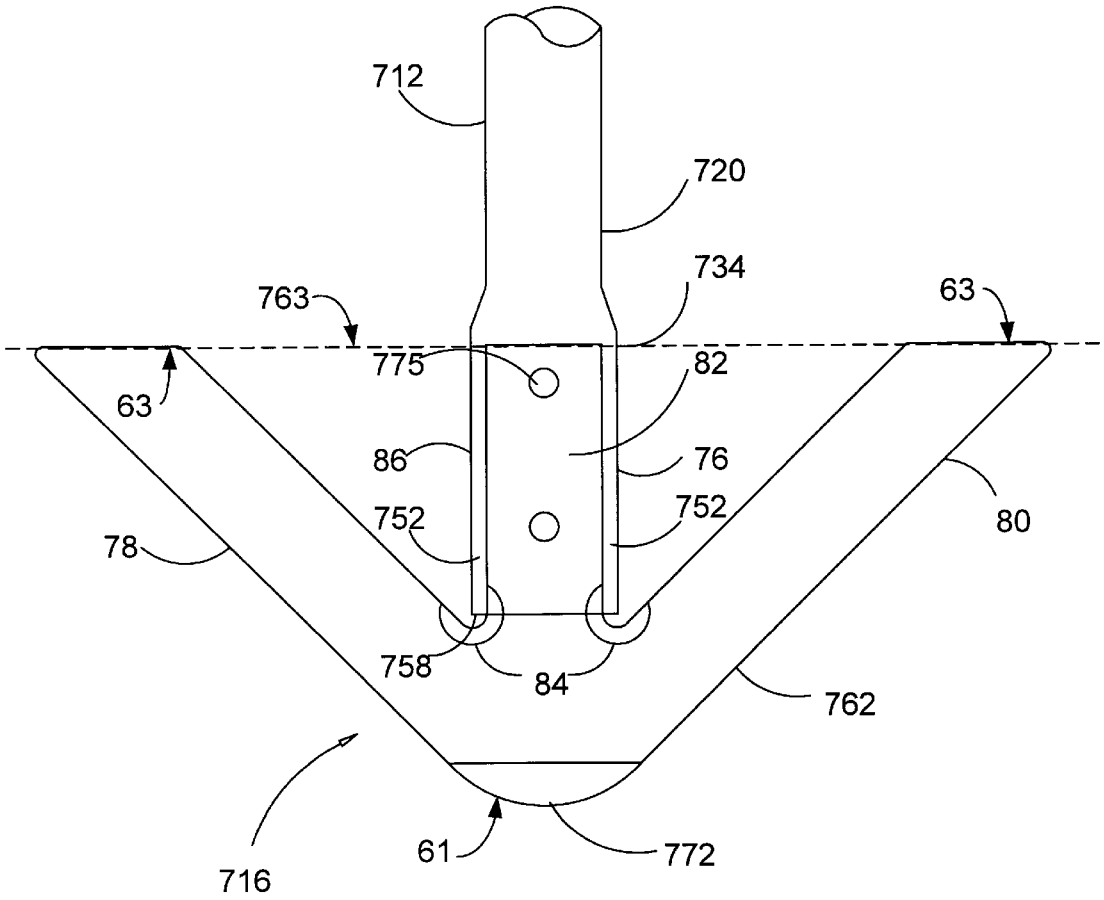
FIG. 6 is a front elevational view (see-through) of the alternative embodiment of FIG. 5.
Figure 7:
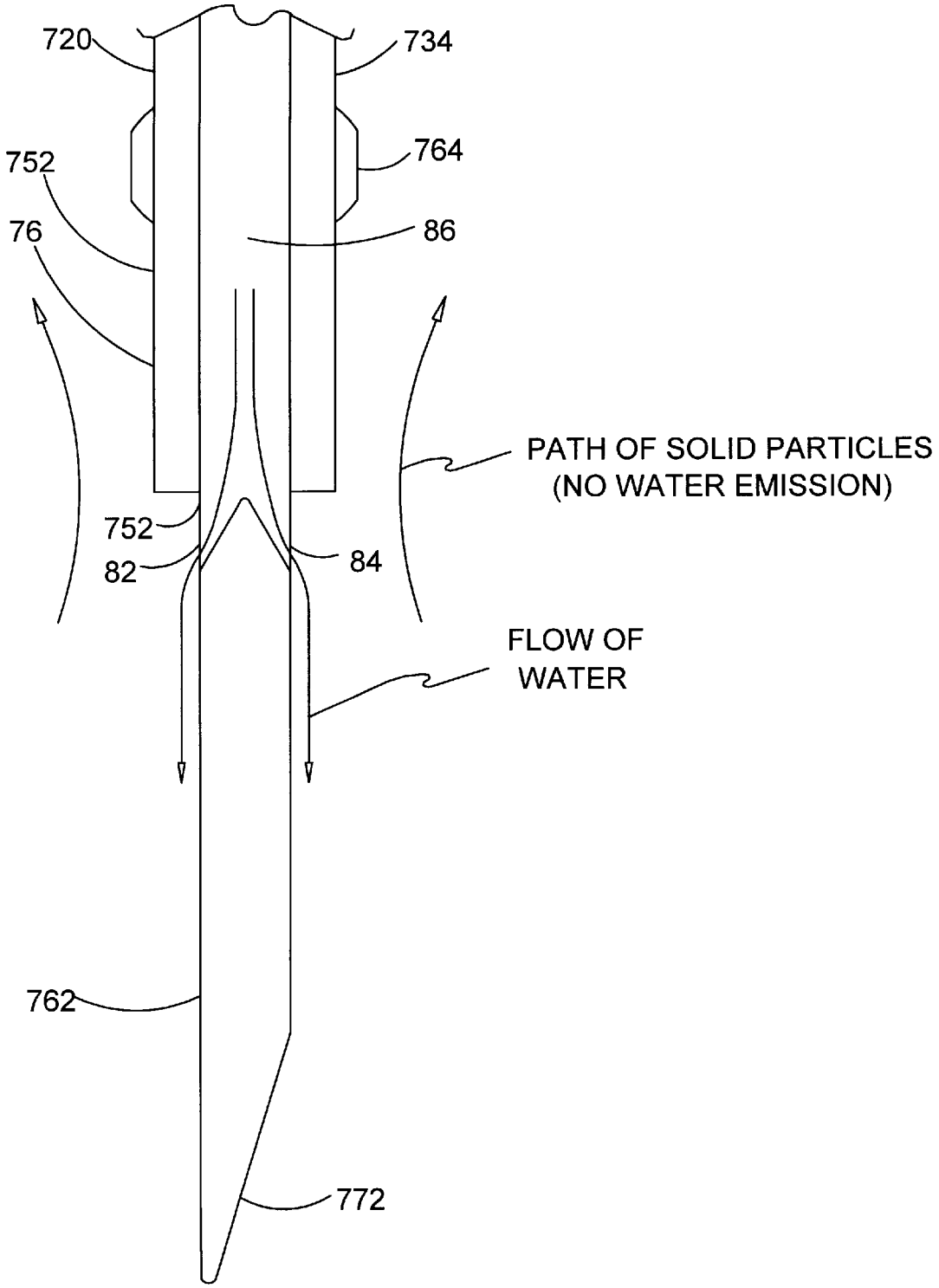
FIG. 7 is a side cross-sectional partial view of the alternative embodiment of FIG. 5.

As another example, and in an alternative embodiment which is now actually preferred, there is shown in the views of FIGS. 5, 6, and 7 a second end 720 and an associated blade assembly 716 which provide certain advantages in addition to those previously described. (In FIGS. 5, 6, and 7, to the extent those elements of the alternative blade assembly 716 and second end 720 are identical or substantially similar to those appearing in the original embodiment 10, those elements will be referred to by a reference number which incorporates the original reference number prefaced with the digit "7.") Referring to FIGS. 5 and 6, at the water-emitting second end 720 of the alternative tubular body 712, rather than the center area of the fourth linear section 734 being completely flattened to produce the aforementioned nozzles 52 and cross-web 54 of the original second end 20, the entire width of the fourth linear section 734 is only partially flattened to give a reception portion 76 having a uniform semi-rectangular, semi-elliptical shape. Extending through the reception portion 76 are pairs of apertures 760 which permit attachment of the blade assembly 716 to the second end 720, but in a different manner than in the original embodiment, as will be described.

The blade assembly 716 again includes a blade 762, having a lower blade edge 61, and a pair of rivets 764. The alternative blade 762 is seen to have an arrow-like or swept back "winged" appearance. Thus, in the drawing figures, there is denoted a pair of opposed left and right wing portions 78 and 80, each having an upper blade edge 63, corresponding to the upper blade edge 63 seen in FIG. 3. A reference line 763 represents the continuation of these two upper blade edges 63 of the wing portions 78, 80. It is to be understood that the term "upper blade edge" will also refer to this reference line 763 in the case where material has been removed from the larger triangle shape to form the winged shape. Bisecting the wing portions (78 and 80), and extending integrally therewith, is a tang 82 (see FIG. 6). The tang 82 has a width that is necessarily less than that of the reception portion 76, as will be explained below. Each of the wing portions (78 and 80) and the tang 82 are fashioned in a conventional metal stamping process from sheet metal and are identically thin and flat.

At the junctures of the wing portions (78 and 80) and tang 82 are located small coined areas 84 where the metal comprising the blade 762 has been made to be thinner and tapered and whose function will also be described below. A blade point 772 has a rounded aspect as before. Although not shown, each wing portion (78 or 80) may also include a flange portion similar to original blade flange 74 or have some other deviation.

The acute, arrow-like shape of the blade 762, like the triangular shape of the original blade 62, assists in the slurrifying of cementitious dry-mix materials by making penetration and movement through these relatively dense materials less difficult. Moreover, the alternative arrow shape presents less surface area, thereby making back and forth horizontal movements of the tool 710 through dense cementitious mixtures less difficult. (It would be apparent that the surface area of the original triangular blade 62 could also be reduced, for example, by introducing perforations. However, the shape of the alternative blade 762 presents further advantages as are described below.)

The tang 82 includes a pair of apertures 775 which are capable of being aligned with the apertures 760 present within the reception portion 76 of the second end 720. During assembly, the tang 82 is inserted into the reception portion 76 and is fixed in a centered fashion therein using rivets 764. The fit of the tang 82 within the reception portion 76 is such that the broad surfaces of the tang 82 are made to be closefitting with respect to the reception portion 76. Conversely, since, as noted previously, the tang 82 has a width less than that of the reception portion 76, there is caused to be formed channels 86 which extend along either side of the tang 76. It will be evident then that these channels 86 perform an identical function to the ducts 56 of the original embodiment. That is, insertion of the tang 82 within the reception portion 76 creates nozzle structures 752 capable of producing a jet action.

The arrangement of the alternative embodiment, in addition to providing a jet action, again provides that the water is emitted relatively close to the blade point 772 to give both the previously described critical water-injecting ability, such that the water is made to go into and beneath the dry mix material to promote rapid self-slurrification, and also the ability to immediately liquefy the dry mix upon contact with the blade 762 to ease penetration and movement through the mixture.

The alternative embodiment provides some additional advantages as well (in addition to the previously mentioned reduced blade 762 area). Referring now also to the side cross-sectional view of FIG. 7, the tapered coined areas 84 provide that the emitted water is only partially deflected by the width of the blade 762 present at the junctures of the left and right wing portions (78 and 80) and the tang 82 and efficiently split the water into two streams. The water is thus emitted along both sides of the blade 762 in a total of four, somewhat fan-shaped streams that still maintain a jet action. The additional streams wet not only a larger area of the blade 762, but also wet more blade 762 surfaces, all of which further facilitates penetration, mixing, and dissolution of the cementitious material.

Further, the tool 710 is now made to have an anti-clogging ability. That is, the channels 86 are largely protected from an influx of solid particles (when water is not being emitted, particularly during downstroking motions) by virtue of the orifices 758 being shielded by the blade 762 thickness present at and near the coined areas 84. (The original embodiment 10 may also be provided with an anti-clogging ability using a check valve arrangement of rubber and/or flexible metal to cover the original orifices 58 when water is not being emitted.)

In addition, the blade 762 is made to be somewhat more securely attached to the second end 720 since the blade 762 is actually inserted into the tubular body 12 rather than being externally attached.

Figure 8:
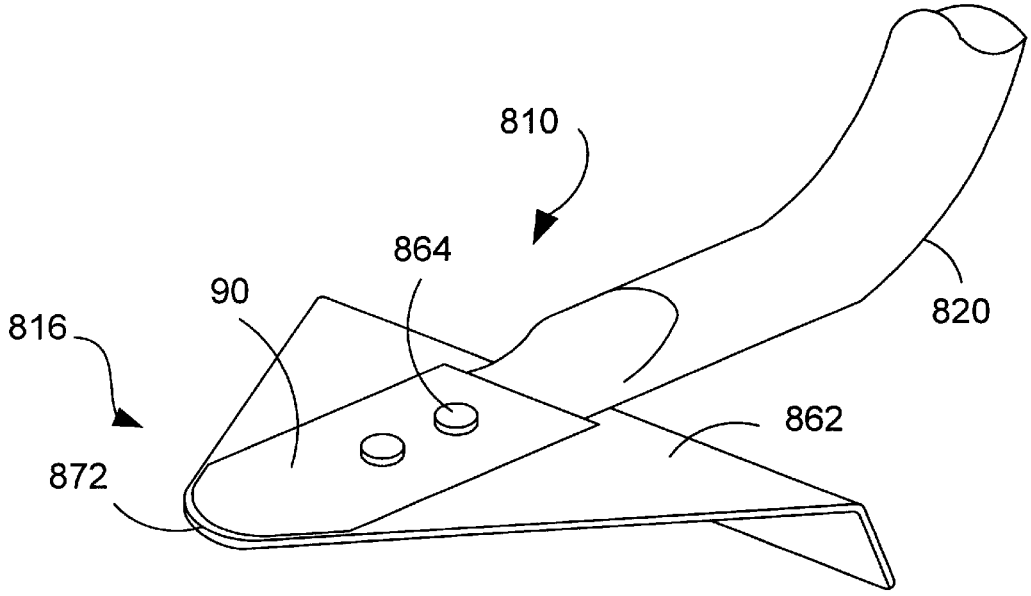
FIG. 8 is a perspective view of a second alternative blade and associated blade assembly with check valve feature.
Figure 10:
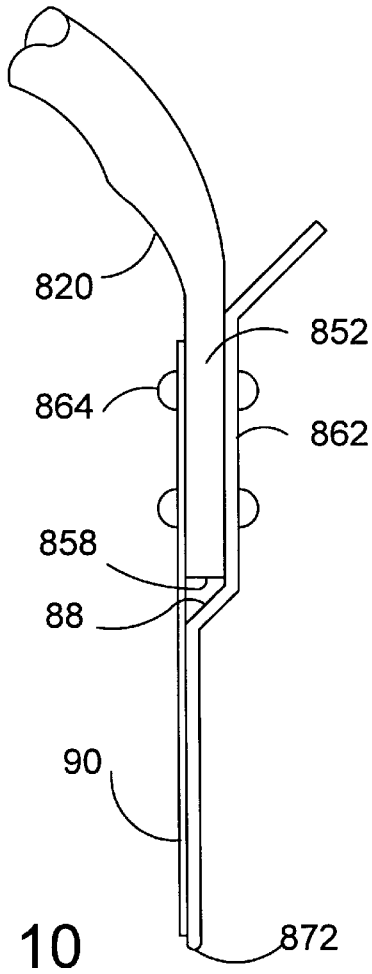
FIG. 10 is a side cross-sectional view of the second alternative embodiment of FIG. 8.
Figure 9:
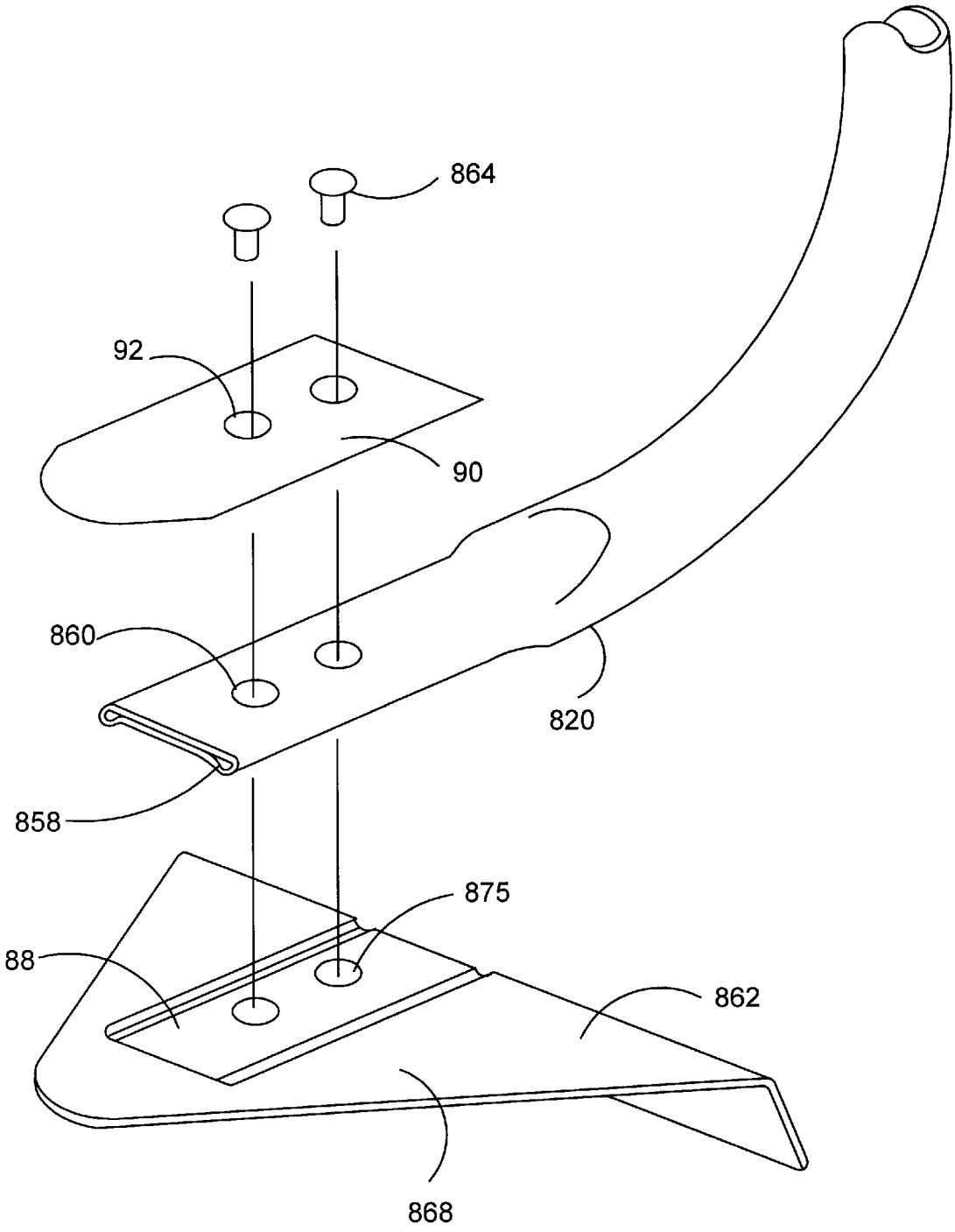
FIG. 9 is an exploded perspective view of the second alternative embodiment of FIG. 8.

A second alternative blade assembly 816 is shown in the views of FIGS. 8, 9, and 10 which constitutes a check valve system for the original embodiment 10. (In FIGS. 8, 9, and 10, to the extent those elements of the alternative blade assembly 816 and second end 820 are identical or substantially similar to those appearing in the original embodiment 10, those elements will be referred to by a reference number which incorporates the original reference number prefaced with the digit "8.")

The blade 862 and second end 820 are as has previously been described for the original embodiment 10, except that the blade 862 is provided in addition with a recessed or depressed portion 88 within which the second end 820 may lie. The depressed portion 88 is of a shallow, generally rectangular shape and is made in a conventional stamping operation by impressing the blade 862. As is perhaps most evident in the view of FIG. 10, the depressed portion 88 is of a depth to accommodate the thickness of the second end 820. As is also shown in FIG. 10, the depressed portion 88 has a length that extends at least slightly beyond the orifices 858 of the second end 820 to permit water emission therefrom. The blade 862 is made of a thinner gauge metal than that of the original blade embodiment 62 but has a similar sturdiness because of the reinforcement provided by the impression stamping.

A flap 90 has a slight concave shape for "spring loading" and has an area sufficient to cover the depressed portion 88 and the second end 820 residing therein. The perimeter of the flap 90 is fashioned to be relatively flush with the rear or second side blade surface 868. The flap 90 includes apertures 92 which are in alignment with the apertures 875 and 860 of the blade 862 and the second end 820, respectively, to permit attachment of both the flap 90 and the second end 820 to the blade 862 with rivets 864 as shown.

In the preferred embodiment, the flap 90 is made of a relatively light gauge spring-type stainless steel such that when water is emitted from the second end 820, the flap 90 is forced to lift from the blade 862 near the blade point 872 in a flexible hinge-like fashion and the water is caused to be sprayed in a jet fan action. When water flow is stopped, the flap 90 again lowers down upon the blade surface 868 in check valve fashion to prevent particulate matter from entering the nozzles 852.

In the embodiment depicted, the outline of the perimeter of the flap 90 at the blade point 872 fairly well matches that of the blade 862. This provides that the water is emitted very close to the blade point 872. It would be apparent that the length of the flap 90 could be shortened somewhat and still provide for emission of water relatively proximate the blade point 872, as is a primary inventive aspect of all of the disclosed embodiments and which, as has been noted many times herein, assists in the facile penetration of the blade 862 into dense and compacted cementitious mixtures and further assists in the mixing and agitation of such materials.

It would be apparent that materials other than stainless steel might be used for the flap 90, such as rubbers, plastics, and other metals, etc. Further, it would also be apparent that similar check valve arrangements could be implemented, perhaps less elegantly, without the use of a depressed portion 88.

In addition to the above mentioned examples, it is to be understood that various other modifications and alterations with regard to the types of materials used, their method of joining and attachment, and the shapes, dimensions and orientations of the components as described may be made without departing from the invention. Accordingly, the above disclosure is not to be considered as limiting and the appended claims are to interpreted as encompassing the entire spirit and scope of the invention.

INDUSTRIAL APPLICABILITY

The water injecting tool 10 of the present invention is designed to efficiently prepare slurries of dry mix products such as cement and mortar with considerably less effort than has been heretofore possible with existing hand tools, whether water-conveying or otherwise.

The tool 10 is used in conjunction with a mixing container such as a bucket or, preferably, a wheel barrow. Use of the tool 10 is simple. The spray gun 38 is first connected to the water hose 37 and dry mix is added to the container, no pre-measurement being required. The tool 10 is held with one hand on the handle portion 35, the other hand gripping the spray gun 38. The blade 62 is initially rested upon the surface of the dry mix, usually at the far end of the container, and the trigger lever 46 of the spray gun 38 actuated. The jet action release of water which occurs from the nozzles 52 causes an immediate liquefaction of material at the blade point 72, allows the blade 70 to quickly penetrate to the bottom of the mixing container, and generally agitates the mixture.

The tool 10 is then drawn toward the user in a manner similar to a garden hoe, the blade flange 74 tending to force the blade 62 downwards and keeping the tool 10 near the bottom of the container during mixing. The worker moves the tool 10 back and forth through the dry mix, stockpiling portions of the mixture at times, and releasing water as necessary to obtain the desired consistency. Material is readily scraped from along the sides and comers of a wheelbarrow due to the angled arrangement of the blade edges 70 and rounded point 72. The circuitous shape of the tubular body 12 provides clearance for the raised sides of the container and makes possible an ergonomic mode of use.

The location of the nozzles 52 near the blade point 72 provides that the water is injected under the dry mix, reducing splash, promoting self-dissolution of the mix, and generally hastening the mixing process. For the foregoing reasons, and for numerous others as have been set forth herein, it is expected that the industrial applicability and commercial utility of the present invention will be extensive and long lasting.

What is claimed is:

1. A tool for use with a fluid supply for mixing cementitious material, comprising:

a handle body having a first end and a second end;

a blade having a first side, a second side, an upper blade edge and a lower blade edge terminating in a tip, said blade depending from the second end;

nozzle means for affording a jet action fluid emission, said nozzle means positioned to emit fluid downwardly from a location closer to the lower blade edge than to the upper blade edge and external to the blade tip, said nozzle means further oriented to direct the emitted fluid substantially parallel to said blade; and fluid conveyance means to convey fluid from said fluid supply to said nozzle means;

whereby the location and orientation of said nozzle means provides that the force of the fluid is used in close conjunction with mechanical action of said blade to assist in penetrating the cementitious material and that the fluid may be injected into and beneath the cementitious material to promote self-slurrification and self-dissolution of dry material.

2. The tool of claim 1 wherein:

said fluid conveyance means includes said handle body being tubular and capable of conveying fluid from the first end to the second end.

3. The tool of claim 2 wherein:

said nozzle means includes the second end of the tubular body being at least partially flattened.

4. The tool of claim 3 wherein:

the flattening is such that a fluid restricting cross web is formed in a center portion of the tubular body with two ducts running in parallel relation at two sides of the cross web, each duct having an orifice of substantially diminished size, the cross web providing a site of attachment for said blade, the diminished orifice size imparting the jet action to the emitted fluid.

5. The tool of claim 3 wherein:

said blade includes a tang, an attachment to the second end of the tubular body including the tang being inserted into the second end to form two channels running in parallel relation at two sides of the tang, each channel having an orifice of substantially diminished size to impart the jet action to the emitted fluid.

6. The tool of claim 5 wherein:

said blade further includes blade areas located in nearby opposition to each orifice, the blade areas having a thickness and a tapered aspect, the thickness of said blade areas blocking an influx of particulate material into the orifices when fluid is not being emitted therefrom, the tapered aspect splitting the emitted fluid into two streams to pass along both the first and second sides of said blade and not substantially diminishing the jet action.

7. The tool of claim 1 wherein:

said handle body is of a circuitous design having, in contiguous integral fashion, a first linear section having a longitudinal axis, a first arcuate section, a transitional second linear section, a second arcuate section, a third linear section bearing an offset, parallel relation to the first linear section, a downturned third arcuate section, and a fourth linear section, the first arcuate section being bent transversely relative to the first and third linear sections to provide an integral handle portion, the second arcuate section bringing the third linear section into parallelity with the first linear section, said blade being attached to the fourth linear section, the tip of said blade being in a location relatively near a projection of the longitudinal axis of said first linear section.

8. The tool of claim 1 wherein:

said blade has a triangular shape, the blade tip being one corner of the triangular shape.

9. The tool of claim 1 wherein:

said blade has an arrow-like form and includes a tang and swept back left and right wing portions extending integrally with the tang, the tang being attached to the second end.

10. The tool of claim 1 wherein:

said fluid conveyance means includes a spray gun attached to the first end.

11. The tool of claim 1 further including:

check valve means for preventing clogging of said nozzle means when said fluid conveyance means is not conveying fluid.

12. The tool of claim 11 wherein:

the check valve means includes said blade having a depressed portion for receiving said nozzle means, and a spring-loaded flap for covering the depressed portion and said nozzle means.

13. A tool for hoeing and mixing operations, comprising:

blade means terminating in a tip;

a handle body having a first end and a second end, said handle body being of a circuitous design and having, in contiguous fashion, a first linear section having a longitudinal axis, a first arcuate section, a transitional second linear section, a second arcuate section, a third linear section bearing an offset, parallel relation to the first linear section, a downturned third arcuate section, and a fourth linear section, the first arcuate section being bent transversely relative to the first and third linear sections to provide an integral handle portion, the second arcuate section bringing the third linear section into parallelity with the first linear section, the tip of said blade means being in a location proximate a projection of the longitudinal axis of said first linear section; and said blade means being attached to the fourth linear section;

whereby the transverse handle portion affords an ergonomic mode of use by placing the hand of a user in a comfortably supinated position and allowing for an efficient transfer of force for back and forth motions, and whereby the downturned third arcuate and fourth linear sections afford the capability of hoeing and mixing over raised obstacles.

14. The tool of claim 13 further including:

fluid supply means for emitting fluid at the second end.

15. The tool of claim 14 wherein:

said fluid supply means includes said handle body being tubular and capable of conveying fluid from the first end to the second end.

16. The tool of claim 13 wherein:

said blade means includes a tang and left and right winged blade portions extending integrally with the tang and permitting passage of material therebetween for ease of movement during said hoeing and mixing.

17. In an improved tool of a type for use with a water supply consisting of a tubular water-conveying handle body having a first end and a second end, valve means for connecting said first end to said water supply, hoe blade means attached to the second end, and at least one water emitting nozzle associated with the second end, wherein said hoe blade means includes a blade having an upper blade edge and a lower blade edge, the improvement comprising:

positioning said at least one nozzle external to said hoe blade means to emit the water from a location closer to the lower blade edge than to the upper blade edge and orientating said at least one nozzle to emit the water in a substantially parallel relation to the blade;

whereby when the tool is used for mixing cementitious material, the force of the water is used in close conjunction with mechanical action of said blade to assist in penetrating the cementitious material and whereby the water may be injected into and beneath the cementitious material to promote self-slurrification and self-dissolution of the cementitious material.

18. The improved tool of claim 17 wherein:

said blade has a generally triangular shape, said lower blade edge being a blade point.

19. The improved tool of claim 18 wherein:

said blade has a winged appearance for reducing resistance to back and forth movement through the cementitious material.

20. The improved tool of claim 19 wherein:

said blade further includes a tang, said second end being adapted for insertable reception of the tang, forming said at least one water emitting nozzle thereby.

* * * * *